US009972954B2

(12) United States Patent
Wu et al.

(10) Patent No.: US 9,972,954 B2
(45) Date of Patent: May 15, 2018

(54) PROTECTION MEMBER AND CONDUCTIVE PLATE ASSEMBLING STRUCTURE OF RAIL TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wei-Chi Chen, New Taipei (TW); Ming-Shan Tai, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days. days.

(21) Appl. No.: 15/648,791

(22) Filed: Jul. 13, 2017

(65) Prior Publication Data

US 2018/0076584 A1 Mar. 15, 2018

(30) Foreign Application Priority Data

Sep. 13, 2016 (TW) ..... 105129742 A

(51) Int. Cl.
*H01R 25/00* (2006.01)
*H01R 25/14* (2006.01)
*H01R 13/432* (2006.01)

(52) U.S. Cl.
CPC ..... *H01R 25/142* (2013.01); *H01R 13/432* (2013.01)

(58) Field of Classification Search
CPC ..... H01R 25/142; H01R 13/432; H01R 13/6666; H02B 11/00
USPC ..... 439/121
See application file for complete search history.

(56) References Cited

U.S. PATENT DOCUMENTS 5,124,876 A * 6/1992 Misencik ..... H01R 13/6666 361/117
5,594,221 A * 1/1997 Drumbor ..... H02B 11/00 200/50.26
9,651,277 B2 * 5/2017 Hansen ..... F24J 2/02
2006/0150815 A1 * 7/2006 Yamada ..... B03C 3/04 96/58
2015/0111426 A1 * 4/2015 Buettner ..... H02G 5/00 439/607.01

* cited by examiner

*Primary Examiner* — Jean F Duverne
(74) *Attorney, Agent, or Firm* — Rosenberg, Klein & Lee

(57) ABSTRACT

A protection member and conductive plate assembling structure of rail terminal includes a conductive plate having two assembling ends and a protection member connected with each assembling end. Two lateral sides of the assembling end are respectively formed with a locating section and a connected section. The protection member has an assembling passage for the assembling end to extend therein. A located section and an elastic connection section are respectively disposed on two sides of the assembling passage corresponding to the locating section and the connected section. The locating section and the located section are engaged with each other. Then the conductive plate is turned to make the connected section push and elastically deform the elastic connection section. Then the elastic connection section elastically restores to its home position to engage with the connected section, whereby the protection member and the conductive plate are securely connected.

28 Claims, 11 Drawing Sheets

PROTECTION MEMBER AND CONDUCTIVE PLATE ASSEMBLING STRUCTURE OF RAIL TERMINAL

BACKGROUND OF THE INVENTION

1. Field of the Invention

The present invention relates generally to a protection member and conductive plate assembling structure of rail terminal, and more particularly to a protection member and conductive plate assembling structure of rail terminal, which can be conveniently assembled and securely located as a whole. In addition, the protection member and conductive plate assembling structure can improve the conductive wire plug-in angle.

2. Description of the Related Art

A conventional terminal structure has an insulation case and a metal component or a metal leaf spring enclosed in the insulation case. The metal leaf spring serves to press and electrically connect with a conductive wire plugged into the terminal. The terminals are arranged and latched on a grounding rail (or conductive rail) to establish a common grounding device of an electrical apparatus or a mechanical apparatus for conducting the residual voltage or static charge of the apparatus.

FIGS. 16, 17 and 18 show a conventional terminal assembling structure currently widely applied to the above grounding rail. The terminal assembling structure mainly includes a conductive plate 7, a protection member 8 and a metal leaf spring 9, which are assembled with each other to form a conductive support structure A. An upright arm 72 is perpendicularly connected with each of two ends of the conductive plate 7 for assembling with the protection member 8, whereby the conductive plate 7 has a U-shaped cross section. In addition, a notch 71 is formed on one side of the conductive plate 7 beside each upright arm 72 near the middle section of the conductive plate 7. A shoulder section 73 is disposed on one side of a top end of the upright arm 72. The protection member 8 is fitted around the upright arm 72. The protection member 8 includes a subsidiary side 85, a first side 81, a second side 82, a third side 83 and a fourth side 84, which are sequentially perpendicularly connected with each other. An opening 86 is defined between the fourth side 84 and the subsidiary side 85, whereby the protection member 8 has a C-shaped cross section for receiving the metal leaf spring 9. At least the subsidiary side 85 serves to guide the metal leaf spring 9 to move in a fixed path. In addition, two notches 821, 841 are respectively formed beside the junctions between the third side 83 and the second and fourth sides 82, 84. The metal leaf spring 9 includes a first section 91 and a bent second section 92 connected with the first section 91. The first section 91 has a tail end 94. The second section 92 has a head end 93. In addition, two lateral protrusion sections 941, 942 are respectively formed on two sides of the first section 91. An outward protruding finger section 95 is disposed on the tail end 94.

When assembled, the protection member 8 is fitted around the upright arm 72 of the conductive plate 7. At this time, the second side 82 and the subsidiary side 85 are respectively fitted on two lateral sides of the upright arm 72 and the finger section 95 of the metal leaf spring 9 is inserted into the notch 71 of the conductive plate 7. The second section 92 is attached to the inner face of the third side 83. Then, the second section 92 and the third side 83 are connected with each other by means of a welding point 80 (as shown in FIG. 17) or a fixing member 800 (as shown in FIG. 18) or any other suitable method. Under such circumstance, the first section 91 extends toward the upright arm 72 with the head end 93 restricted by the shoulder section 73 from moving outward. Therefore, the head end 93 permits the conductive wire to easily plug into the terminal, while hindering the conductive wire from being extracted out of the terminal in a reverse direction.

However, in practice, the above structure has the following shortcomings:

1. The first side 81 of the protection member 8 contacts the outer side of the upright arm 72. The finger section 95 of the connected metal leaf spring 9 is inserted into the notch 71 so as to connect with the conductive plate 7. Such connection manner fails to make the protection member 8 securely connected with the conductive plate 7 and located. When the conductive wire applies an outward pulling force to the metal leaf spring 9, the protection member 8 and the conductive plate 7 are very apt to loosen and detach from each other.
2. In practice, the structure of the notch 71 for locating the conductive plate 7 indirectly affects the design of the conductive plate 7. Two end sections of the conductive plate 7 must have the bent upright arms 72. (Practically, the upright arms 72 are bent to be approximately normal to the conductive plate 7). Only in this case, the head end 93 of the metal leaf spring 9 can contact the shoulder section 73 of the upright arm 72. This limits the plug-in angle and direction of the external conductive wire inserted into the terminal. The conductive wire must be inserted into the protection member 8 in a direction normal to the conductive plate 7. In this case, the conductive wire on the outer lateral side of the conductive support A must be first bent upward and then reversely bent downward so that the conductive wire can be plugged into the protection member 8 to connect with the metal leaf spring 9. This not only leads to inconvenience in working (especially the conductive wire with larger diameter is uneasy to bend), but also will occupy more room.

It is therefore tried by the applicant to provide a protection member and conductive plate assembling structure of rail terminal to solve the above shortcomings of the conventional protection member and conductive plate assembling structure of rail terminal.

SUMMARY OF THE INVENTION

It is therefore a primary object of the present invention to provide a protection member and conductive plate assembling structure of rail terminal. The protection member and conductive plate assembling structure includes a conductive plate and a protection member. The conductive plate has two assembling ends. Two lateral sides of each assembling end are respectively formed with a recessed/raised locating section and a recessed/raised connected section. The protection member has an assembling passage for the assembling end to extend therein. A located section is disposed on one side of the assembling passage for the locating section to inlay and connect therewith. An elastic connection section is disposed on the other side of the assembling passage corresponding to the connected section. When assembled, the locating section and the located section are first engaged with each other. Then, the conductive plate is turned to make the connected section push and elastically deform the elastic connection section. After the connected section passes through the elastic connection section, the elastic connection section elastically restores to its home position to engage with the connected section. Accordingly, the protection member and the conductive plate are securely connected and located without easy axial sliding or radial loosening or detachment.

It is a further object of the present invention to provide the above protection member and conductive plate assembling structure of rail terminal. When assembled, the assembling end of the conductive plate is extended into the assembling passage. The locating section on one side of the assembling end is first obliquely engaged with the located section. Then, the assembling end is turned to make the connected section on the other side push the elastic connection section and elastically deform the elastic connection section. Then, the elastic connection section elastically restores to its home positions to abut against, engage with and locate the connected section. Under such circumstance, the protection member and the conductive plate are securely connected with each other. It is quite convenient to assemble and process the entire protection member and conductive plate assembling structure so that the manufacturing cost is effectively lowered.

It is still a further object of the present invention to provide the above protection member and conductive plate assembling structure of rail terminal. The protection member is prevented from sliding in the axial direction of the conductive plate. Therefore, it is unnecessary to bend the assembling end of the conductive plate into an upright state in adaptation to the protection member. This can effectively improve the angle and direction in which the external conductive wire is plugged into the protection member.

To achieve the above and other objects, the protection member and conductive plate assembling structure of rail terminal of the present invention includes: a conductive plate having at least one assembling end, a locating section and a connected section being respectively disposed on two lateral sides of the assembling end; and a protection member having an assembling passage for the assembling end to extend therein. A contact wall is disposed on one side of the assembling passage for attaching to the assembling end. A located section is disposed on one side of the contact wall in adjacency to and corresponding to the locating section. One side of the contact wall is bent and connected with a sidewall in adjacency to the connected section. The sidewall is formed with an elastic connection section corresponding to the connected section. When assembled, the assembling end of the conductive plate extends into the assembling passage. The locating section on one side is first engaged with the located section. Then, the connected section on the other side pushes and elastically deforms the elastic connection section. After the elastic connection section elastically restores to its home position, the connected section is engaged and located by the elastic connection section so that the protection member and the conductive plate can be securely connected with each other without easy sliding, loosening or detachment.

In the above protection member and conductive plate assembling structure, one of the locating section and the located section is a recessed section, while the other of the locating section and the located section is a raised section corresponding to the recessed section.

In the above protection member and conductive plate assembling structure, two sides of the recessed section are formed with engagement sections, while two sides of the raised section are formed with outward expanding chucking sections. The raised section is inlaid in the recessed section with the chucking sections snugly engaged with the engagement sections, whereby the locating section and the located section are securely assembled with each other without easy loosening or detachment.

In the above protection member and conductive plate assembling structure, the connected section includes at least one raised abutment section disposed on one side of the assembling end. The elastic connection section includes at least one elastic tongue section disposed on the sidewall. The elastic tongue section extends from a middle section of the sidewall to the contact wall corresponding to the raised abutment section.

In the above protection member and conductive plate assembling structure, a small-width lateral raised section is disposed at a junction between the sidewall and the contact wall of the protection member. A receiving recess corresponding to the lateral raised section is formed on the conductive plate in a position where the connected section is positioned.

In the above protection member and conductive plate assembling structure, the raised abutment section is disposed in the receiving recess. The sidewall of the protection member is formed with a slot extending from the middle section of the sidewall to the contact wall corresponding to the raised abutment section.

In the above protection member and conductive plate assembling structure, the elastic tongue section is disposed in the slot.

In the above protection member and conductive plate assembling structure, one side of the conductive plate is formed with two raised abutment sections respectively disposed on two sides of the receiving recess. The sidewall of the protection member is formed with two elastic tongue sections respectively disposed on two sides of the lateral raised section corresponding to the raised abutment sections.

In the above protection member and conductive plate assembling structure, the distance between the two elastic tongue sections is gradually enlarged from the middle section of the sidewall to the contact wall.

In the above protection member and conductive plate assembling structure, the protection member is a hoop-like structure body formed of thin metal plate by bending.

The present invention can be best understood through the following description and accompanying drawings, wherein:

DETAILED DESCRIPTION OF THE PREFERRED EMBODIMENTS

Figure 1:
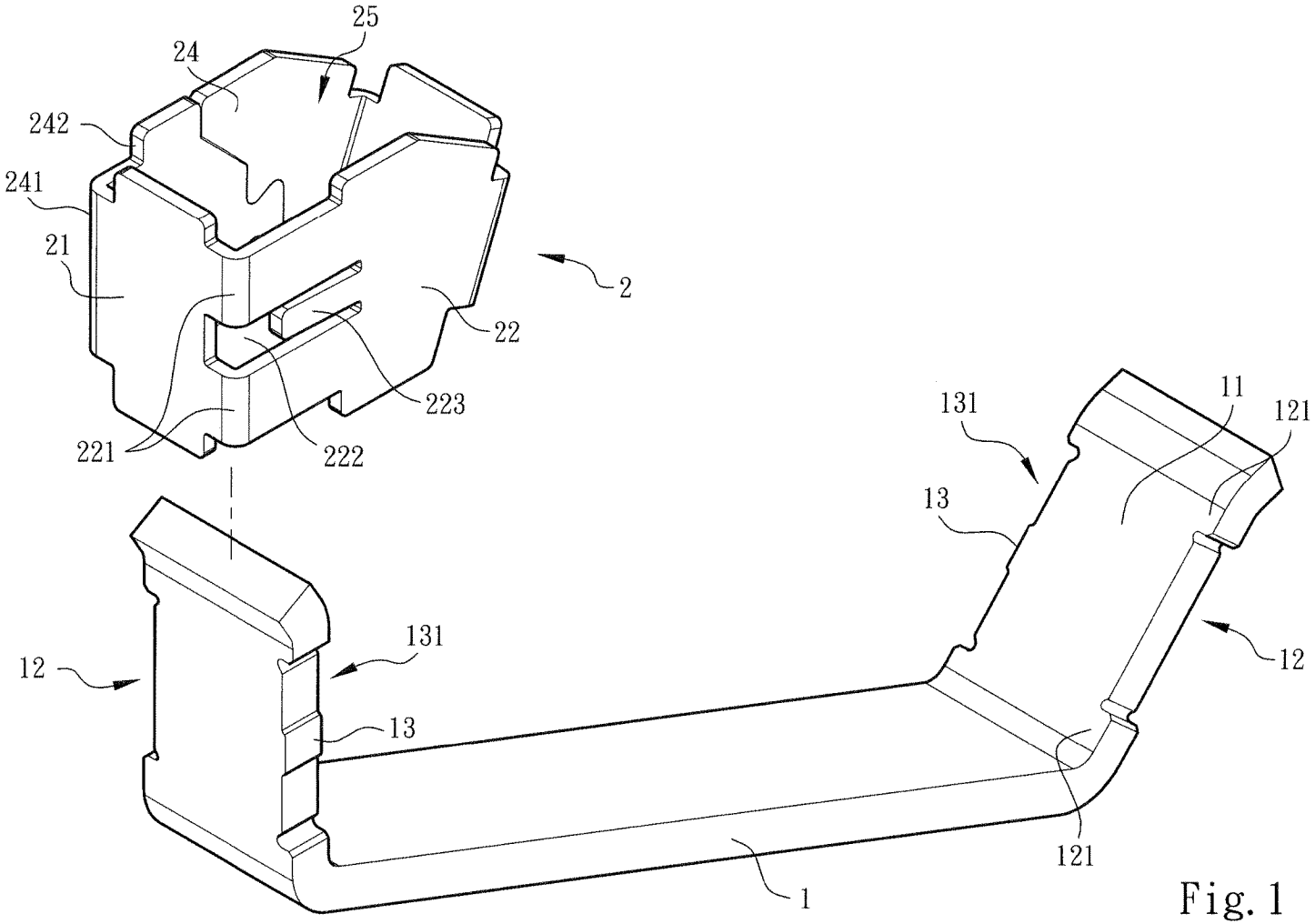
FIG. 1 is a perspective exploded view of a first embodiment of the present invention.
Figure 3:
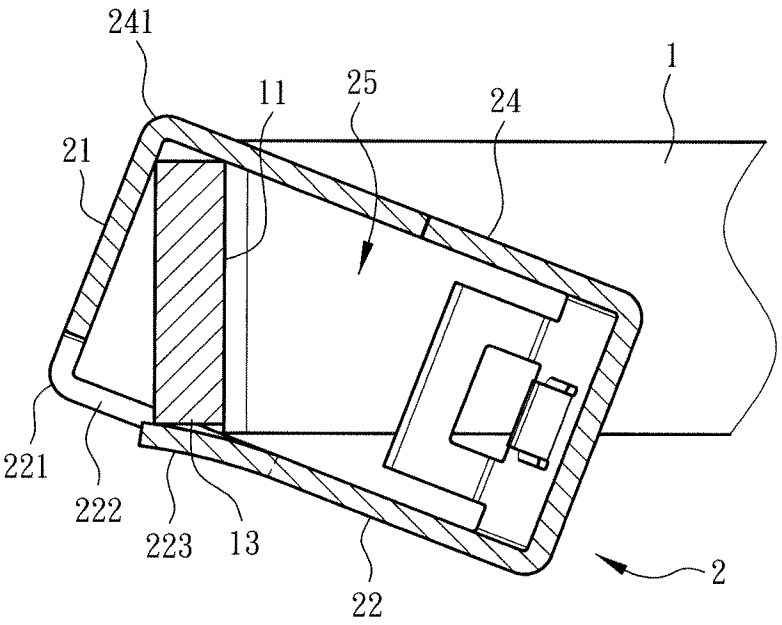
FIG. 3 is a top sectional view according to FIG. 2.
Figure 2:
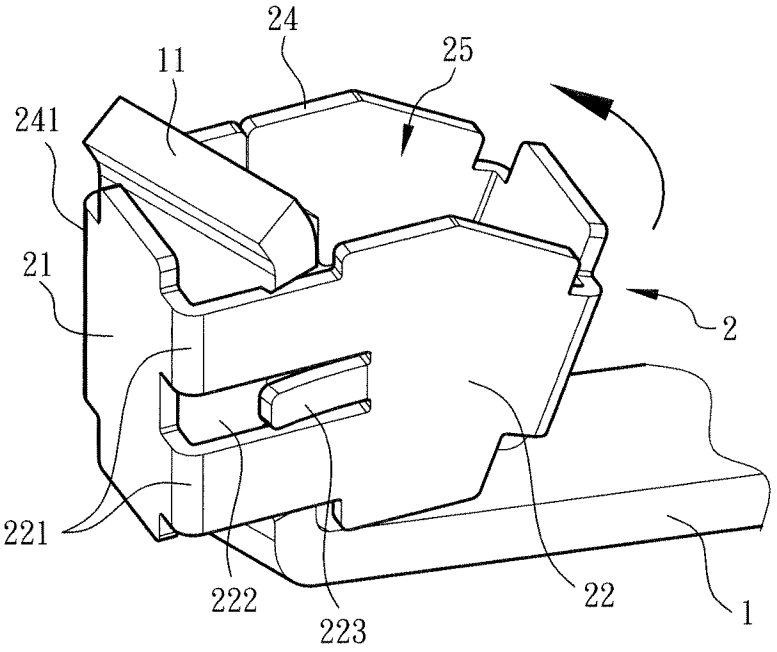
FIG. 2 is a perspective view showing the assembling process of the first embodiment of the present invention.
Figure 5:
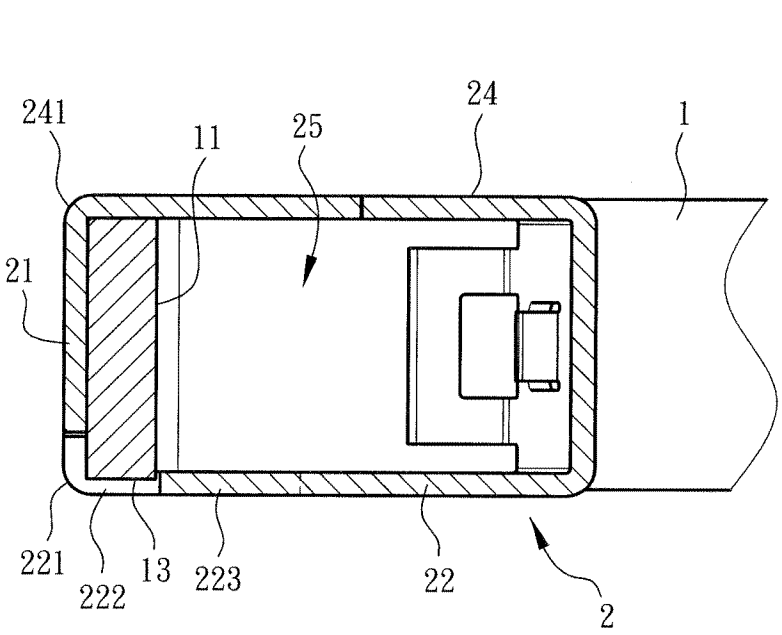
FIG. 5 is a top sectional view according to FIG. 4.
Figure 4:
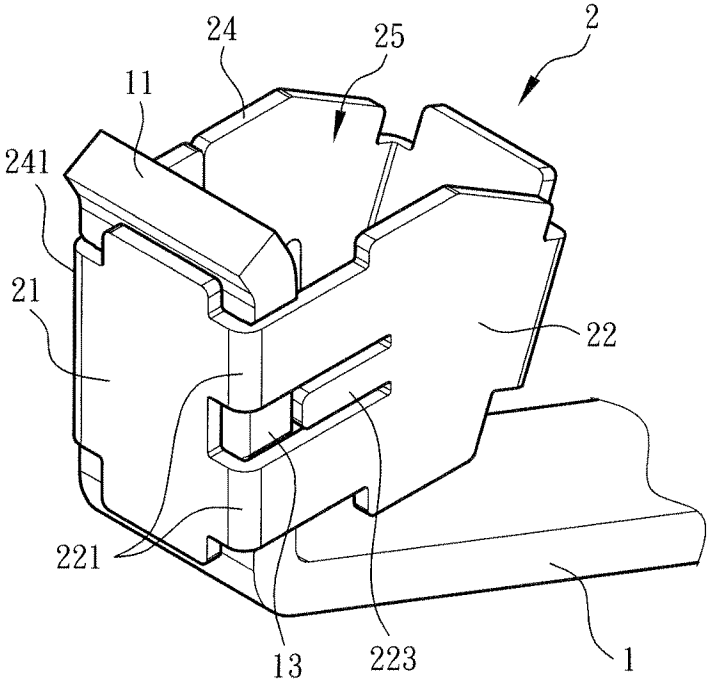
FIG. 4 is a perspective assembled view of the first embodiment of the present invention.

Please refer to FIGS. 1 to 5. According to a first embodiment, the protection member and conductive plate assembling structure of rail terminal of the present invention mainly includes a conductive plate 1 and a protection member 2. Each of two end sections of the conductive plate 1 is formed with an assembling end 11. Two lateral sides of the assembling end 11 are respectively formed with a locating section 12 and a connected section 13.

In this embodiment, the locating section 12 is a recessed section. Two sides of the recessed section are formed with engagement sections 121. The connected section 13 is a raised abutment section disposed on one side of the assembling end 11.

In a preferred embodiment, one side of the assembling end 11 of the conductive plate 1 is formed with a receiving recess 131. The connected section 13 (the raised abutment section) is positioned in the receiving recess 131.

The protection member 2 is a hoop-like structure body formed of thin metal plate by bending. The protection member 2 is formed with an internal assembling passage 25 passing through the protection member 2. A contact wall 21 is disposed on one side of the assembling passage 25 for attaching to the assembling end 11. Two sides of the contact wall 21 are respectively bent and connected with two sidewalls 22, 24. The sidewall 24 is disposed on one side of the contact wall 21 in adjacency to the locating section 12. A located section 241 is disposed at the junction between the sidewall 24 and the contact wall 21 corresponding to the locating section 12. The sidewall 22 is disposed on one side of the contact wall 21 in adjacency to the connected section 13. The sidewall 22 is formed with an elastic connection section 223 corresponding to the connected section 13.

In this embodiment, the located section 241 is a small-width bent raised section connected between the sidewall 24 and the contact wall 21. In addition, the sidewall 24 is formed with two outward expanding chucking sections 242 in adjacency to two sides of the located section 241 (the raised section). The elastic connection section 223 is an elastic tongue section extending from a middle section of the sidewall 22 to the contact wall 21 corresponding to the connected section 13 (the raised abutment section). Moreover, a gap is reserved between the elastic tongue section and one face of the contact wall 21 proximal to the assembling passage 25. The gap has a width at least equal to the thickness of the conductive plate 1.

In a preferred embodiment, a small-width lateral raised section 221 is disposed at the junction between the sidewall 22 and the contact wall 21. The lateral raised section 221 can be snugly inlaid in the receiving recess 131 and located therein. The sidewall 22 is formed with a slot 222 extending from the middle section of the sidewall 22 to the contact wall 21 corresponding to the connected section 13 (the raised abutment section). The elastic connection section 223 (the elastic tongue section) is positioned in the slot 222.

When assembled, the assembling end 11 of the conductive plate 1 is obliquely extended into the assembling passage 25. The locating section 12 (the recessed section) on one side of the assembling end 11 is first fitted with the located section 241 (the raised section). Then, the assembling end 11 is turned to make the connected section 13 (the raised abutment section) on the other side push the elastic connection section 223 (the elastic tongue section) and elastically deform the elastic connection section 223. Then, the connected section 13 (the raised abutment section) is inlaid into the slot 222 and the elastic connection section 223 (the elastic tongue section) elastically restores to its home position to abut against the upper side of the connected section 13 (the raised abutment section). Under such circumstance, the protection member 2 and the conductive plate 1 are securely connected with each other.

In the above structure, the located section 241 (the raised section) is fitted in the locating section 12 (the recessed section) and the connected section 13 (the raised abutment section) is cooperatively inlaid in the slot 222. Accordingly, the protection member 2 is located and prevented from sliding in the axial direction of the conductive plate 1. In addition, the chucking sections 242 are engaged on the engagement sections 121 and the elastic connection section 223 (the elastic tongue section) abuts against the upper side of the connected section 13 (the raised abutment section). In this case, the assembling end 11 is effectively prevented from moving into the assembling passage 25 to cause radial loosening (of the conductive plate 1).

Figure 6:
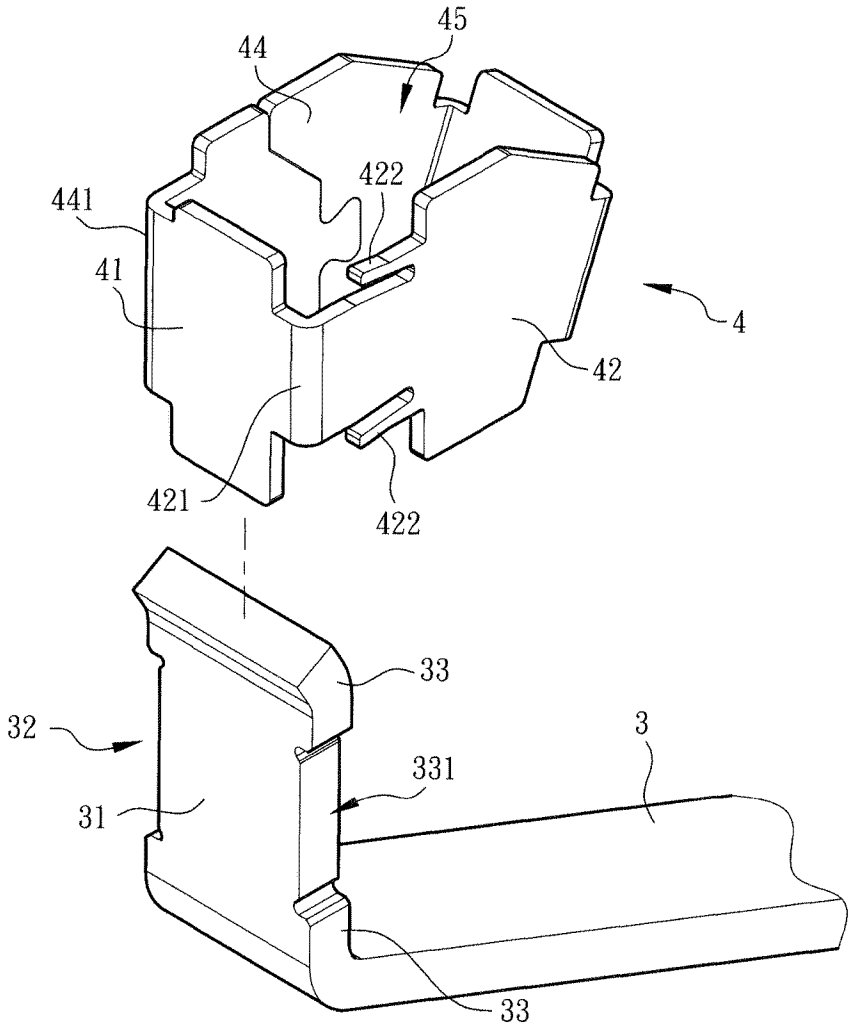
FIG. 6 is a perspective exploded view of a second embodiment of the present invention.
Figure 8:
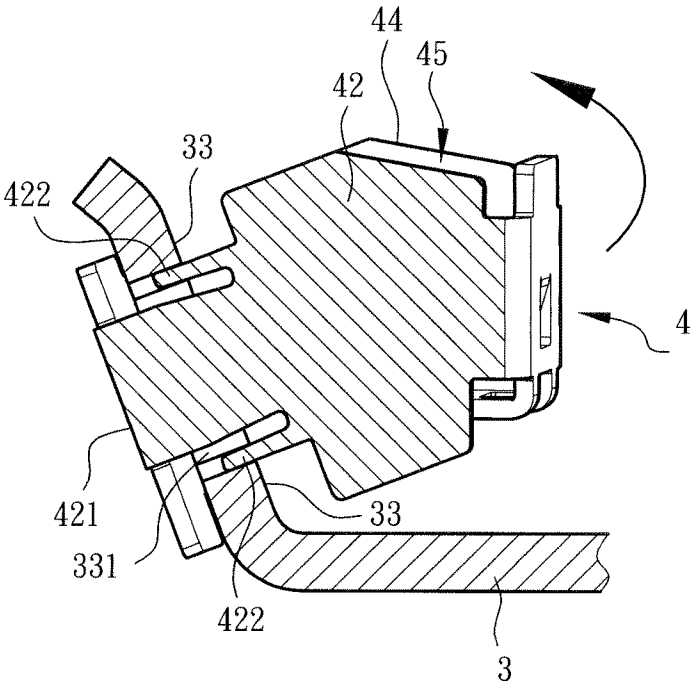
FIG. 8 is a side sectional view according to FIG. 7.
Figure 7:
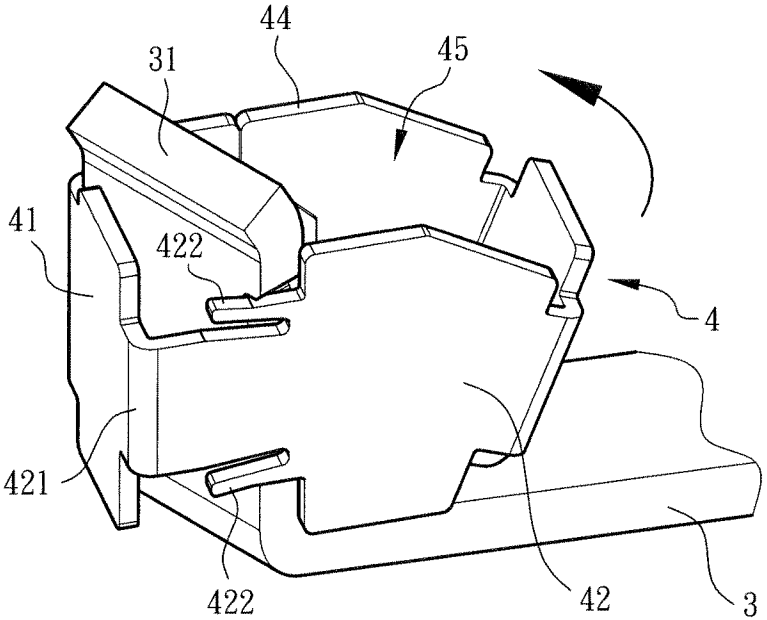
FIG. 7 is a perspective view showing the assembling process of the second embodiment of the present invention.
Figure 10:
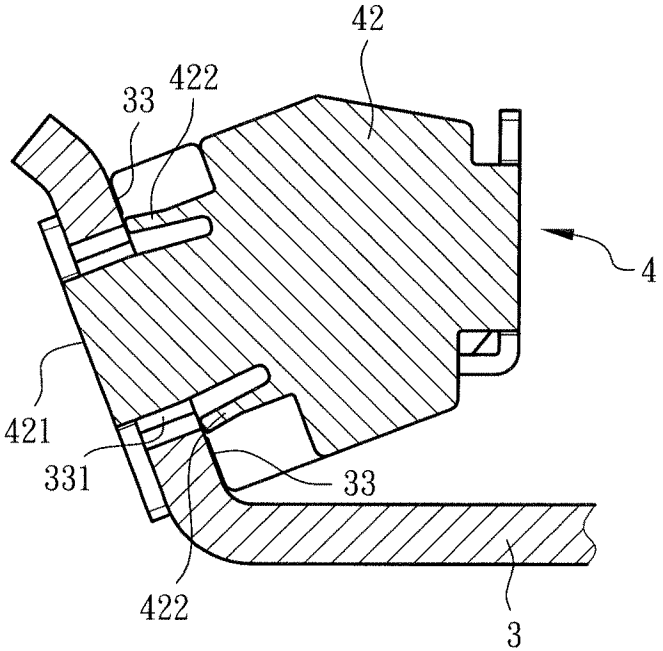
FIG. 10 is a side sectional view according to FIG. 9.
Figure 9:
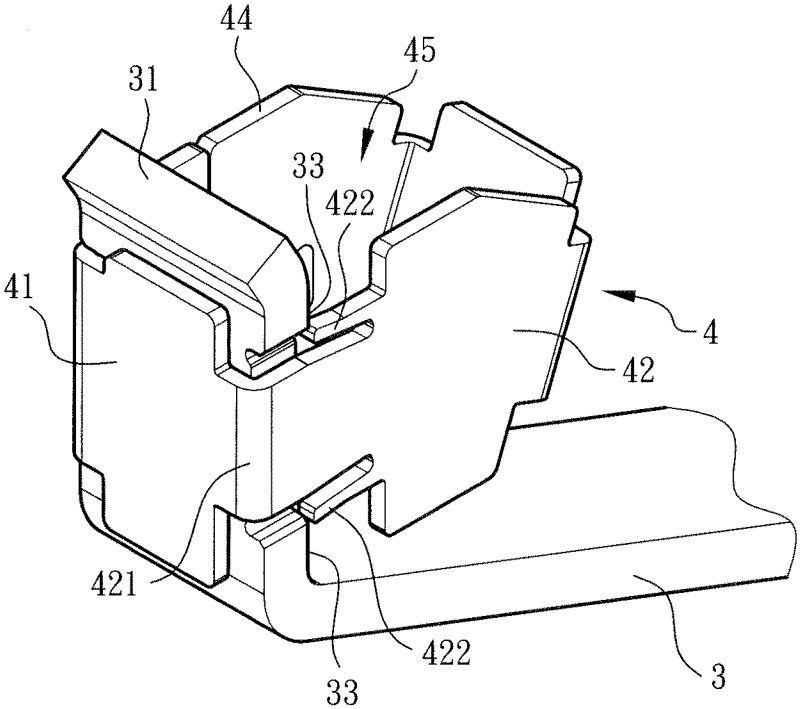
FIG. 9 is a perspective assembled view of the second embodiment of the present invention.

Please now refer to FIGS. 6 to 10. According to the second embodiment, the present invention mainly includes a conductive plate 3 and a protection member 4. Each of two end sections of the conductive plate 3 is formed with an assembling end 31. Two lateral sides of the assembling end 31 are respectively formed with a locating section 32 and a connected section 33.

In this embodiment, the locating section 32 is a recessed section. One side of the assembling end 31 is formed with a receiving recess 331. The connected section 33 has two raised abutment sections positioned on two sides of the receiving recess 331.

The protection member 4 is a hoop-like structure body formed of thin metal plate by bending. The protection member 4 is formed with an internal assembling passage 45 passing through the protection member 4. A contact wall 41 is disposed on one side of the assembling passage 45 for attaching to the assembling end 31. Two sides of the contact wall 41 are respectively bent and connected with two sidewalls 42, 44. The sidewall 44 is disposed on one side of the contact wall 41 in adjacency to the locating section 32. A located section 441 is disposed at the junction between the sidewall 44 and the contact wall 41 corresponding to the locating section 32. The sidewall 42 is disposed on one side of the contact wall 41 in adjacency to the connected section 33. The sidewall 42 is formed with elastic connection sections 422 corresponding to the connected section 33.

In this embodiment, the located section 441 is a small-width bent raised section connected between the sidewall 44 and the contact wall 41. The elastic connection sections 422 are two elastic tongue sections extending from a middle section of the sidewall 42 to the contact wall 41 respectively corresponding to the two raised abutment sections. Moreover, the distance between the two elastic tongue sections is gradually enlarged from the middle section of the sidewall 42 to the contact wall 41. A gap is reserved between each elastic tongue section and one face of the contact wall 41 proximal to the assembling passage 45. The gap has a width at least equal to the thickness of the conductive plate 3.

In a preferred embodiment, a small-width lateral raised section 421 is disposed at the junction between the sidewall 42 and the contact wall 41. The lateral raised section 421 can be snugly inlaid in the receiving recess 331.

When assembled, the assembling end 31 of the conductive plate 3 is obliquely extended into the assembling passage 45. The locating section 32 (the recessed section) on one side of the assembling end 31 is first fitted with the located section 441 (the raised section). Then, the assembling end 31 is turned to make the receiving recess 331 on the other side fitted on outer sides of the elastic connection section 422 (the two elastic tongue sections). Along with the turning of the assembling end 31, the two elastic tongue sections are compressed and elastically deformed to get closer to each other until the lateral raised section 421 extends into the receiving recess 331. Then, the elastic connection section 422 (the two elastic tongue sections) elastically restores to their home positions to abut against the upper sides of the connected section 33 (the two raised abutment sections). Under such circumstance, the protection member 4 and the conductive plate 3 are securely connected with each other.

In the above structure, the located section 441 (the raised section) is fitted in the locating section 32 (the recessed section) and the lateral raised section 421 is cooperatively inlaid in the receiving recess 331. Accordingly, the protection member 4 is prevented from sliding in the axial direction of the conductive plate 3. In addition, the elastic connection sections 422 (the two elastic tongue sections) abut against the upper side of the connected section 33 (the two raised abutment sections). In this case, the assembling end 31 is effectively prevented from moving into the assembling passage 45 to cause radial loosening (of the conductive plate 3).

Figure 11:
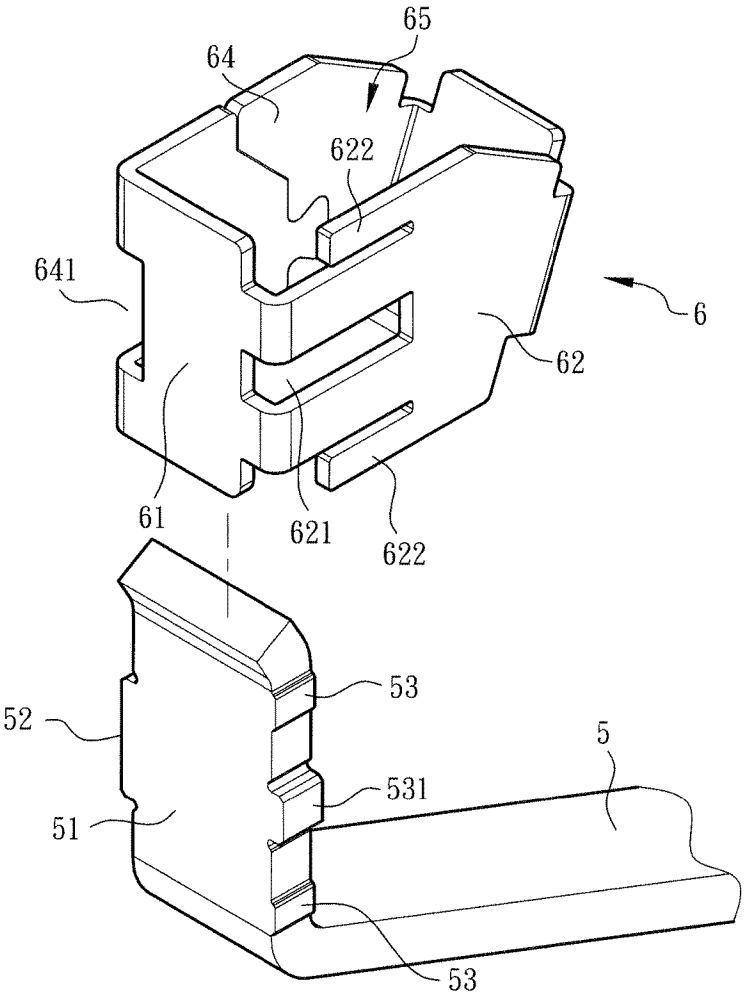
FIG. 11 is a perspective exploded view of a third embodiment of the present invention.
Figure 13:
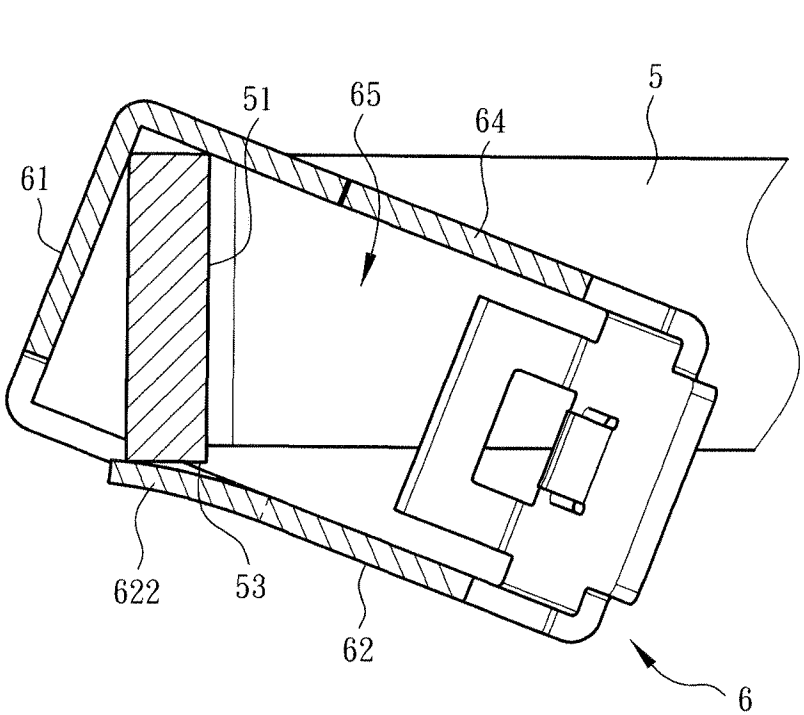
FIG. 13 is a top sectional view according to FIG. 12.
Figure 12:
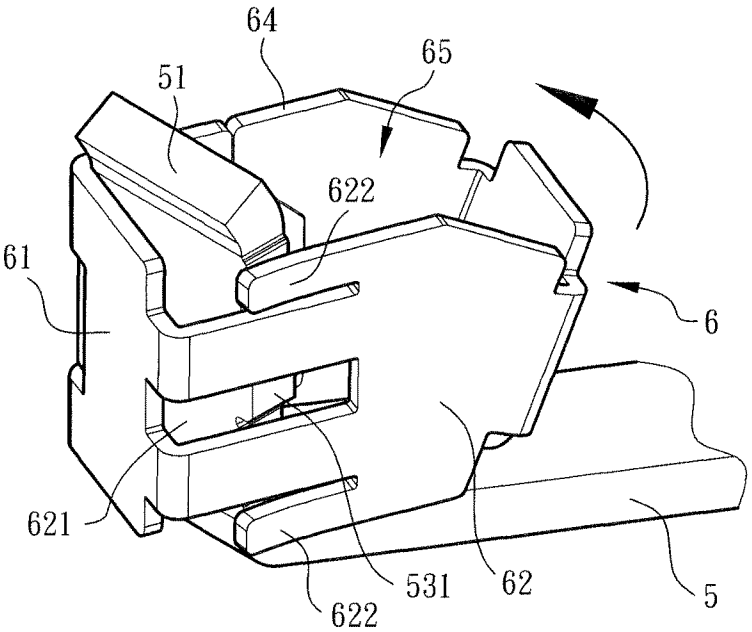
FIG. 12 is a perspective view showing the assembling process of the third embodiment of the present invention.
Figure 15:
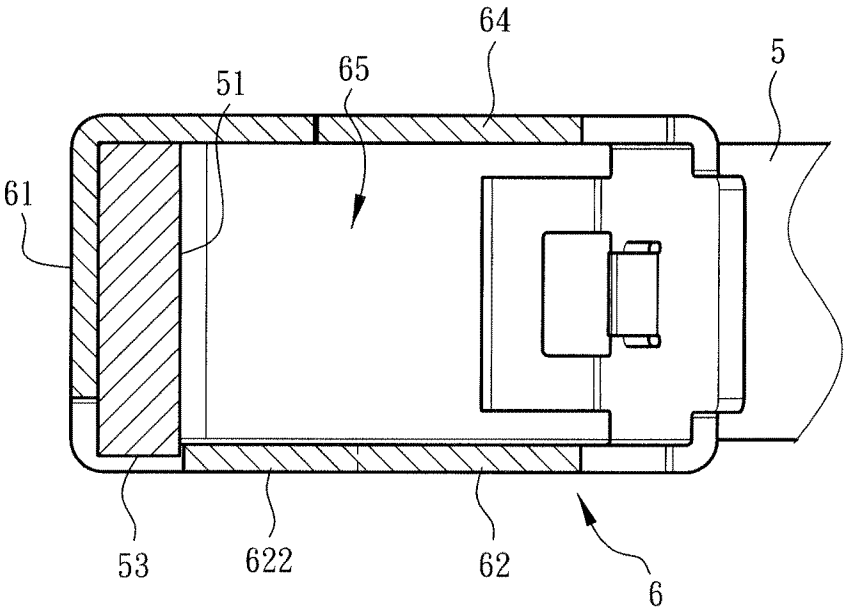
FIG. 15 is a top sectional view according to FIG. 14.
Figure 14:
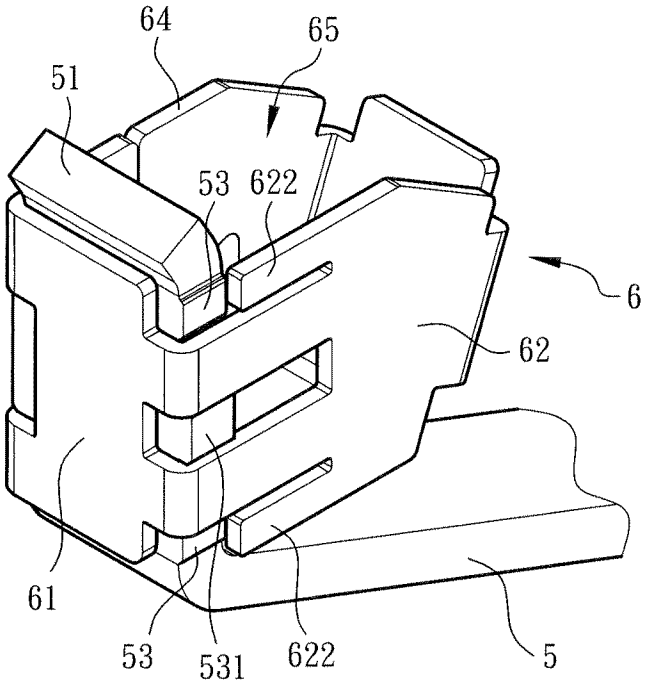
FIG. 14 is a perspective assembled view of the third embodiment of the present invention.
Figure 16:
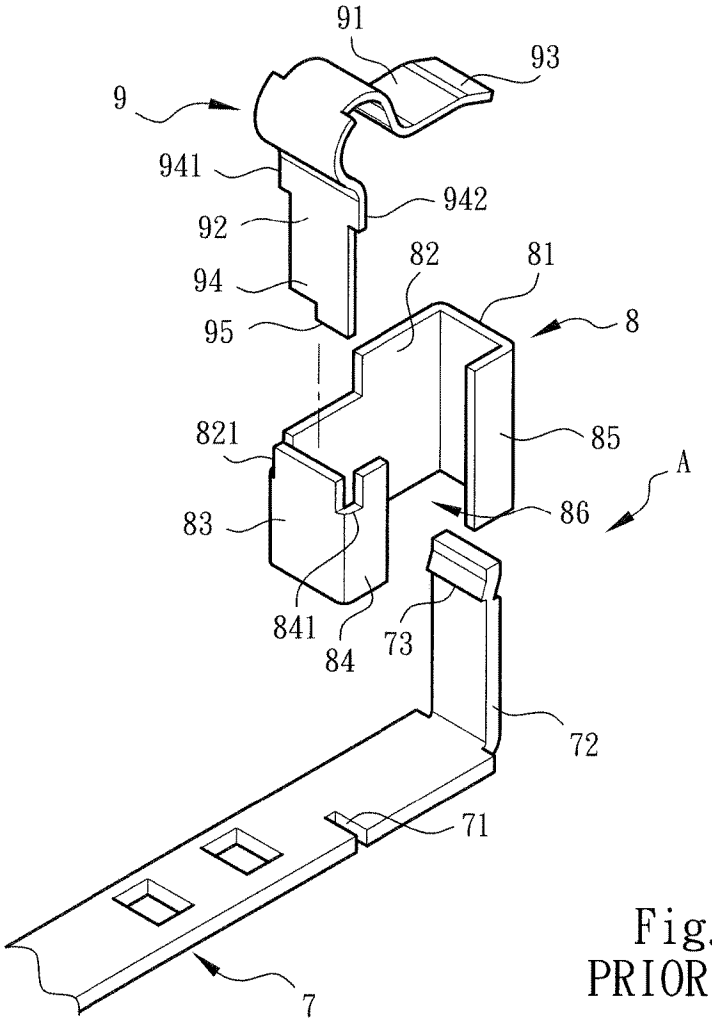
Fig. 16 PRIOR ART
FIG. 16 is a perspective exploded view of a conventional rail terminal.
Figure 18:
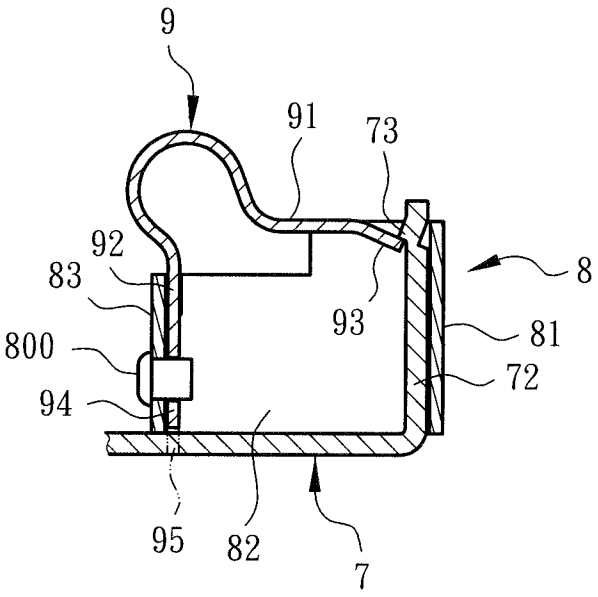
Fig. 18 PRIOR ART
FIG. 18 is a side sectional view of the conventional rail terminal, in which the structure of FIG. 16 is connected by means of a fixing member.
Figure 17:
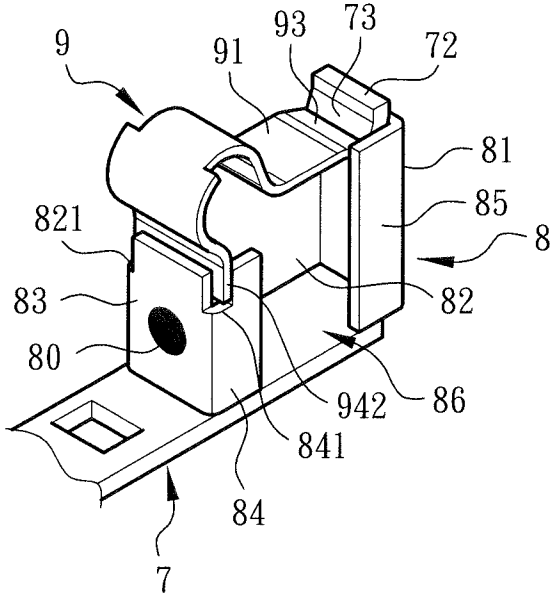
Fig. 17 PRIOR ART
FIG. 17 is a perspective assembled view of the conventional rail terminal, in which the structure of FIG. 16 is connected by means of welding.

Please now refer to FIGS. 11 to 15. According to the third embodiment, the present invention mainly includes a conductive plate 5 and a protect ion member 6. Each of two end sections of the conductive plate 5 is formed with an assembling end 51. Two lateral sides of the assembling end 51 are respectively formed with a locating section 52 and a connected section 53.

In this embodiment, the locating section 52 is a raised section. The connected section 53 has two raised abutment sections. In addition, another raised abutment section 531 is disposed between the two raised abutment sections of the connected section 53.

The protection member 6 is a hoop-like structure body formed of thin metal plate by bending. The protection member 6 is formed with an internal assembling passage 65 passing through the protection member 6. A contact wall 61 is disposed on one side of the assembling passage 65 for attaching to the assembling end 51. Two sides of the contact wall 61 are respectively bent and connected with two sidewalls 62, 64. The sidewall 64 is disposed on one side of the contact wall 61 in adjacency to the locating section 52. A located section 641 is disposed at the junction between the sidewall 64 and the contact wall 61 corresponding to the locating section 52. The sidewall 62 is disposed on one side of the contact wall 61 in adjacency to the connected section 53. The sidewall 62 is formed with elastic connection sections 622 corresponding to the connected section 53.

In this embodiment, the located section 641 is a small-width recessed section positioned between the sidewall 64 and the contact wall 61. The elastic connection sections 622 are two elastic tongue sections extending from a middle section of the sidewall 62 to the contact wall 61 respectively corresponding to the connected section 53 (the two raised abutment sections). Moreover, a gap is reserved between each elastic tongue section and one face of the contact wall 61 proximal to the assembling passage 65. The gap has a width at least equal to the thickness of the conductive plate 5. In addition, the sidewall 62 is formed with a slot 621 extending from the middle section of the sidewall 62 to the contact wall 61 corresponding to the raised abutment section 531.

When assembled, the assembling end 51 of the conductive plate 5 is obliquely extended into the assembling passage 65. The locating section 52 (the raised section) on one side of the assembling end 51 is first inlaid into the located section 641 (the recessed section). Then, the assembling end 51 is turned to make the connected section 53 (the two raised abutment sections) on the other side push the elastic connection section 622 (the two elastic tongue sections) and elastically deform the elastic connection section 622. Then, the raised abutment section 531 is inlaid into the slot 621 and the elastic connection section 622 (the two elastic tongue sections) elastically restores to its home position to abut against the upper side of the connected section 53 (the two raised abutment sections). Under such circumstance, the protection member 6 and the conductive plate 5 are securely connected with each other.

In the above structure, the locating section 52 (the raised section) is inlaid in the located section 641 (the recessed section) and the raised abutment section 531 is cooperatively inlaid in the slot 621. Accordingly, the protection member 6 is prevented from sliding in the axial direction of the conductive plate 5. In addition, the elastic connection sections 622 (the two elastic tongue sections) abut against the upper side of the connected section 53 (the two raised abutment sections). In this case, the assembling end 51 is effectively prevented from moving into the assembling passage 65 to cause radial loosening (of the conductive plate 5).

In conclusion, the protection member and conductive plate assembling structure of rail terminal of the present invention can truly simplify the assembling process and enhance the locating effect. In addition, the present invention provides various plug-in and assembling angles for the conductive wire as necessary. The present invention is inventive and advanced.

The above embodiments are only used to illustrate the present invention, not intended to limit the scope thereof. Many modifications of the above embodiments can be made without departing from the spirit of the present invention.

What is claimed is:

1. A protection member and conductive plate assembling structure of rail terminal, comprising:

a conductive plate having at least one assembling end, at least one connected section being disposed on one side of the assembling end; and a protection member having an assembling passage for the assembling end to extend therein, a contact wall being disposed on one side of the assembling passage for attaching to the assembling end, one side of the contact wall being bent and connected with a sidewall in adjacency to the connected section, the sidewall being formed with an elastic connection section corresponding to the connected section, the assembling end of the conductive plate extending into the assembling passage and the connected section pushing and passing through the elastic connection section, whereby after the elastic connection section elastically restores to its home position, the connected section is engaged and located by the elastic connection section so that the protection member and the conductive plate can be securely connected with each other without easy loosening or detachment.

2. The protection member and conductive plate assembling structure of rail terminal as claimed in claim 1, wherein a locating section is disposed on the other side away from the connected section on the assembling end, a located section is further disposed on one side of the contact wall in adjacency to the locating section and corresponding to the locating section, whereby the locating section on one side can be engaged with the located section.

3. The protection member and conductive plate assembling structure of rail terminal as claimed in claim 2, wherein one of the locating section and the located section is a recessed section, while the other of the locating section and the located section is a raised section corresponding to the recessed section.

4. The protection member and conductive plate assembling structure of rail terminal as claimed in claim 3, wherein two sides of the recessed section are formed with engagement sections, while two sides of the raised section are formed with outward expanding chucking sections, the raised section being inlaid in the recessed section with the chucking sections snugly engaged with the engagement sections, whereby the locating section and the located section are securely assembled with each other without easy loosening or detachment.

5. The protection member and conductive plate assembling structure of rail terminal as claimed in claim 1, wherein the connected section includes at least one raised abutment section disposed on one side of the assembling end, the elastic connection section including at least one elastic tongue section disposed on the sidewall, the elastic tongue section extending from a middle section of the sidewall to the contact wall corresponding to the raised abutment section.

6. The protection member and conductive plate assembling structure of rail terminal as claimed in claim 1, wherein at least one lateral raised section is disposed at a junction between the sidewall and the contact wall of the protection member, a receiving recess corresponding to the lateral raised section being formed on the conductive plate in a position where the connected section is positioned.

7. The protection member and conductive plate assembling structure of rail terminal as claimed in claim 2, wherein at least one lateral raised section is disposed at a junction between the sidewall and the contact wall of the protection member, a receiving recess corresponding to the lateral raised section being formed on the conductive plate in a position where the connected section is positioned.

8. The protection member and conductive plate assembling structure of rail terminal as claimed in claim 3, wherein at least one lateral raised section is disposed at a junction between the sidewall and the contact wall of the protection member, a receiving recess corresponding to the lateral raised section being formed on the conductive plate in a position where the connected section is positioned.

9. The protection member and conductive plate assembling structure of rail terminal as claimed in claim 4, wherein at least one lateral raised section is disposed at a junction between the sidewall and the contact wall of the protection member, a receiving recess corresponding to the lateral raised section being formed on the conductive plate in a position where the connected section is positioned.

10. The protection member and conductive plate assembling structure of rail terminal as claimed in claim 5, wherein at least one lateral raised section is disposed at a junction between the sidewall and the contact wall of the protection member, a receiving recess corresponding to the lateral raised section being formed on the conductive plate in a position where the connected section is positioned.

11. The protection member and conductive plate assembling structure of rail terminal as claimed in claim 10, wherein the connected section includes at least one raised abutment section disposed on one side of the assembling end, the elastic connection section including at least one elastic tongue section disposed on the sidewall, the elastic tongue section extending from the middle section of the sidewall to the contact wall corresponding to the raised abutment section, the raised abutment section being disposed in the receiving recess, the sidewall of the protection member being formed with a slot extending from the middle section of the sidewall to the contact wall corresponding to the raised abutment section.

12. The protection member and conductive plate assembling structure of rail terminal as claimed in claim 11, wherein the elastic tongue section is disposed in the slot.

13. The protection member and conductive plate assembling structure of rail terminal as claimed in claim 10, wherein one side of the conductive plate is formed with two raised abutment sections respectively disposed on two sides of the receiving recess, the sidewall of the protection member being formed with two elastic tongue sections respectively disposed on two sides of the lateral raised section corresponding to the raised abutment sections.

14. The protection member and conductive plate assembling structure of rail terminal as claimed in claim 13, wherein a distance between the two elastic tongue sections is gradually enlarged from the middle section of the sidewall to the contact wall.

15. The protection member and conductive plate assembling structure of rail terminal as claimed in claim 1, wherein the protection member is a hoop-like structure body formed of thin metal plate by bending.

16. The protection member and conductive plate assembling structure of rail terminal as claimed in claim 2, wherein the protection member is a hoop-like structure body formed of thin metal plate by bending.

17. The protection member and conductive plate assembling structure of rail terminal as claimed in claim 3, wherein the protection member is a hoop-like structure body formed of thin metal plate by bending.

18. The protection member and conductive plate assembling structure of rail terminal as claimed in claim 4, wherein the protection member is a hoop-like structure body formed of thin metal plate by bending.

19. The protection member and conductive plate assembling structure of rail terminal as claimed in claim 5, wherein the protection member is a hoop-like structure body formed of thin metal plate by bending.

20. The protection member and conductive plate assembling structure of rail terminal as claimed in claim 6, wherein the protection member is a hoop-like structure body formed of thin metal plate by bending.

21. The protection member and conductive plate assembling structure of rail terminal as claimed in claim 7, wherein the protection member is a hoop-like structure body formed of thin metal plate by bending.

22. The protection member and conductive plate assembling structure of rail terminal as claimed in claim 8, wherein the protection member is a hoop-like structure body formed of thin metal plate by bending.

23. The protection member and conductive plate assembling structure of rail terminal as claimed in claim 9, wherein the protection member is a hoop-like structure body formed of thin metal plate by bending.

24. The protection member and conductive plate assembling structure of rail terminal as claimed in claim 10, wherein the protection member is a hoop-like structure body formed of thin metal plate by bending.

25. The protection member and conductive plate assembling structure of rail terminal as claimed in claim 11, wherein the protection member is a hoop-like structure body formed of thin metal plate by bending.

26. The protection member and conductive plate assembling structure of rail terminal as claimed in claim 12, wherein the protection member is a hoop-like structure body formed of thin metal plate by bending.

27. The protection member and conductive plate assembling structure of rail terminal as claimed in claim 13, wherein the protection member is a hoop-like structure body formed of thin metal plate by bending.

28. The protection member and conductive plate assembling structure of rail terminal as claimed in claim 14, wherein the protection member is a hoop-like structure body formed of thin metal plate by bending.

* * * * *